US008276597B1

(12) United States Patent
Harden

(10) Patent No.: US 8,276,597 B1
(45) Date of Patent: Oct. 2, 2012

(54) SUNSCREEN APPLICATOR AND METHOD OF USING SAME

(75) Inventor: Triskin Harden, Birmingham, AL (US)

(73) Assignee: Tattoo Armor, LLC, Hoover, AL (US)

( * ) Notice: Subject to any disclaimer, the term of this patent is extended or adjusted under 35 U.S.C. 154(b) by 201 days.

(21) Appl. No.: 12/783,163

(22) Filed: May 19, 2010

Related U.S. Application Data

(60) Provisional application No. 61/180,474, filed on May 22, 2009.

(51) Int. Cl.
*A45D 7/00* (2006.01)

(52) U.S. Cl. ..... 132/200

(58) Field of Classification Search ..... 132/320, 132/200, 317
See application file for complete search history.

(56) References Cited

U.S. PATENT DOCUMENTS

| | | | | | |
|---|---|---|---|---|---|
| 3,351,074 | A | * | 11/1967 | Aston | 401/135 |
| 3,358,699 | A | * | 12/1967 | Bau | 401/70 |
| 3,829,224 | A | * | 8/1974 | Kloosterhouse | 401/130 |
| 3,989,392 | A | * | 11/1976 | Seidler | 401/66 |
| D285,172 | S | | 8/1986 | Scuderi | |
| 4,699,161 | A | * | 10/1987 | Smith et al. | 132/73.5 |
| 4,875,602 | A | | 10/1989 | Chickering et al. | |
| 4,892,427 | A | * | 1/1990 | Ford | 401/182 |
| 5,052,418 | A | * | 10/1991 | Miller | 132/319 |
| 5,611,687 | A | | 3/1997 | Wagner | |
| 5,908,256 | A | | 6/1999 | Bernstein | |
| 5,938,363 | A | | 8/1999 | Timms et al. | |
| 5,960,802 | A | | 10/1999 | Sakai | |
| D458,456 | S | * | 6/2002 | Dragan et al. | D4/119 |
| D472,344 | S | | 3/2003 | Angeletta | |
| 6,773,189 | B1 | | 8/2004 | Tsaur | |
| 6,832,867 | B2 | | 12/2004 | Sandbach et al. | |
| 7,086,796 | B2 | * | 8/2006 | Severa | 401/179 |
| 7,241,451 | B1 | * | 7/2007 | Edell et al. | 424/401 |
| 7,781,041 | B2 | * | 8/2010 | Broyles | 428/40.1 |
| 7,784,467 | B2 | * | 8/2010 | Spottheim et al. | 128/898 |
| 2002/0164193 | A1 | * | 11/2002 | Brown | 401/270 |
| 2004/0127838 | A1 | * | 7/2004 | Jeziak | 602/43 |
| 2006/0008313 | A1 | | 1/2006 | Wisniewski | |
| 2007/0127980 | A1 | | 6/2007 | Tamez | |
| 2009/0092435 | A1 | | 4/2009 | Stevens | |

* cited by examiner

*Primary Examiner* — Robyn Doan
(74) *Attorney, Agent, or Firm* — C. Brandon Browning; Maynard Cooper & Gale, PC

(57) ABSTRACT

A sunscreen applicator including a reservoir containing a sunscreen, and an applicator tip in fluid communication with the reservoir, the applicator tip being configured for applying the sunscreen at a predetermined point and along a predetermined line on a user's body. In use, the sunscreen is applied from the tip to the user's body at a predetermined point on the body, such as mole, or along a predetermined line, such as a along cut or a tattoo.

9 Claims, 6 Drawing Sheets

SUNSCREEN APPLICATOR AND METHOD OF USING SAME

FIELD OF THE INVENTION

The present invention relates to an apparatus and method of using same for applying sunscreen precisely, and more particularly to a method of applying sunscreen to tattooed skin without depositing the sunscreen to surrounding non-tattooed skin.

BACKGROUND OF THE INVENTION

It is well known that exposing the ink of a tattoo to sunlight causes the ink to fade and appear cracked and distorted. For this reason, tattooed skin is often protected with sunscreen lotion. Typically, the sunscreen lotion is applied by hand which results in the deposition of the sunscreen lotion not only to the tattooed skin but also to the non-tattooed skin immediately surrounding the tattooed skin. The result is the formation of a halo around the tattooed skin where the skin around the ink looks lighter than the skin that surrounds the non-tattooed skin immediately surrounding the tattooed skin. This can occur when sunscreen lotion is applied to the tattooed skin and surrounding non-tattooed skin but not to the rest of the user's body. It can also occur if the user applies a sunscreen lotion to the tattooed skin and surrounding non-tattooed skin having a sun protection factor ("SPF") that is greater than the SPF of a sunscreen lotion that is applied to the rest of the user's body.

SUMMARY OF THE INVENTION

The present invention is directed to a sunscreen applicator and method of using same for applying the sunscreen to precise points and along lines on a user's body. The sunscreen can be provided as a liquid, a lotion, a gel, or a semi-solid. In one aspect of the invention there is provided a precision sunscreen applicator including an elongate body, a reservoir formed within the elongate body, an applicator tip in fluid communication with the reservoir, and a sunscreen contained within the reservoir. Preferably, the applicator tip is provided as a brush having a diameter of between about 1/16 of an inch and about 3/16 of an inch. To assist advancement of the sunscreen from the reservoir to the applicator tip, a manually operated plunger means may be included within the reservoir for pressing the sunscreen toward the applicator tip.

In another aspect of the invention there is provided a method of applying sunscreen to a body including providing an applicator having a reservoir containing a sunscreen and an applicator tip in fluid communication with the reservoir, the tip having a diameter of less than 3/16 of an inch and being configured for applying the sunscreen to skin. In use, the sunscreen is forced onto or out of the applicator tip by turning a knob on the applicator that it is operatively coupled to a plunger in the reservoir which presses the sunscreen toward the applicator tip. The sunscreen is then applied from the tip to the user's body at a predetermined point on the body or along a predetermined line. For example, the sunscreen can be applied to a mole for protecting the mole from sunlight while allowing the surrounding skin to be tanned. Additionally, the sunscreen can be applied along a cut or incision for preventing or inhibiting scarring along the cut and incision or along the lines of a tattoo.

In yet another aspect of the invention there is provided a method of applying sunscreen to tattooed skin including providing an applicator having a reservoir containing a sunscreen and an applicator tip in fluid communication with the reservoir, the tip being configured for applying the sunscreen to a predetermined point or along a predetermined line on a user's body. In use, the sunscreen is applied from the tip to the tattooed skin without applying the sunscreen to non-tattooed skin directly adjacent to the tattooed skin.

DETAILED DESCRIPTION OF PRESENTLY PREFERRED EMBODIMENTS

Figure 1:
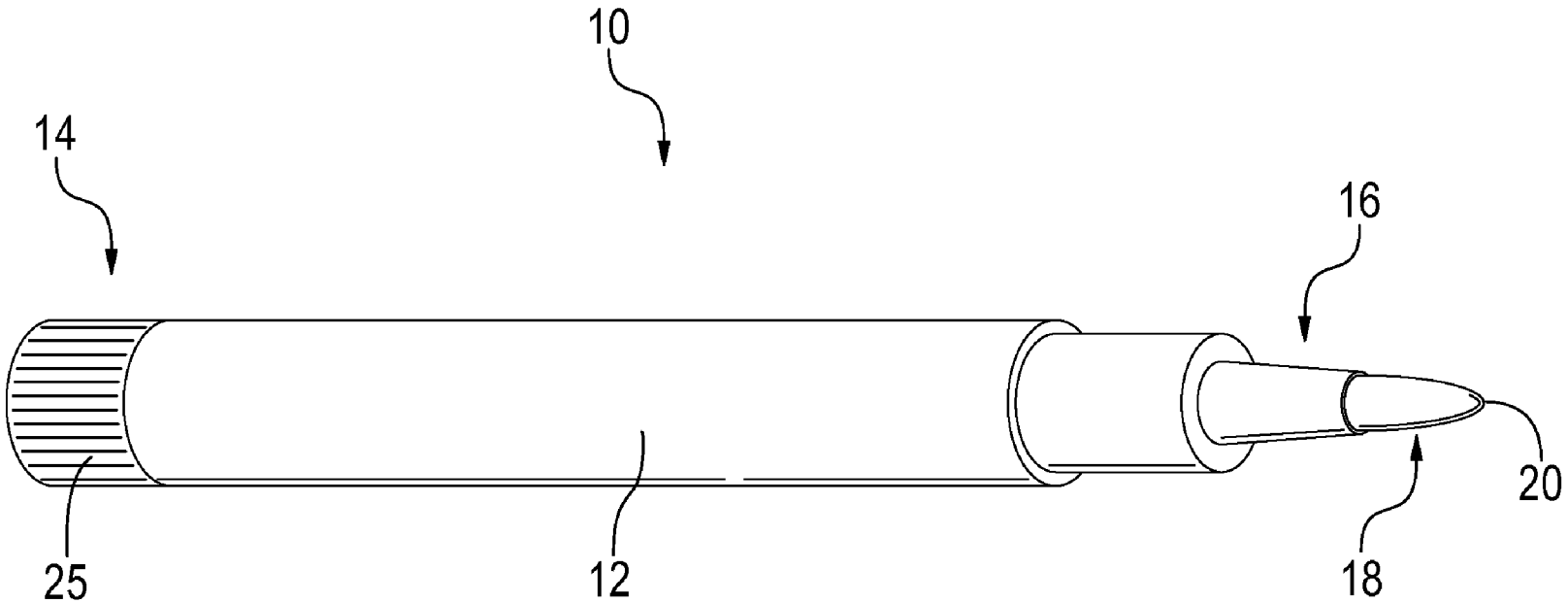
FIG. 1 is a perspective view of a sunscreen applicator in accordance with a preferred embodiment of the invention.
Figure 2:
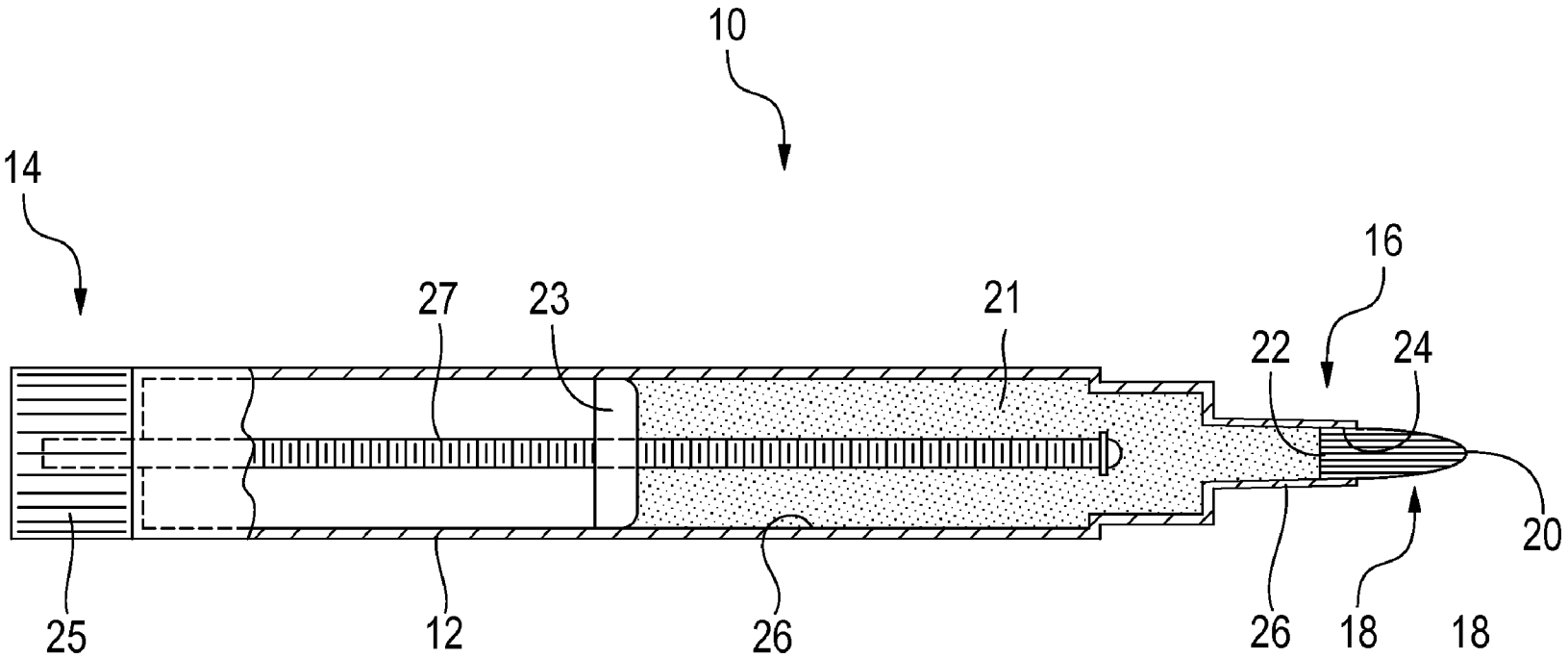
FIG. 2 is a sectional view of the applicator of FIG. 1.
Figure 3:
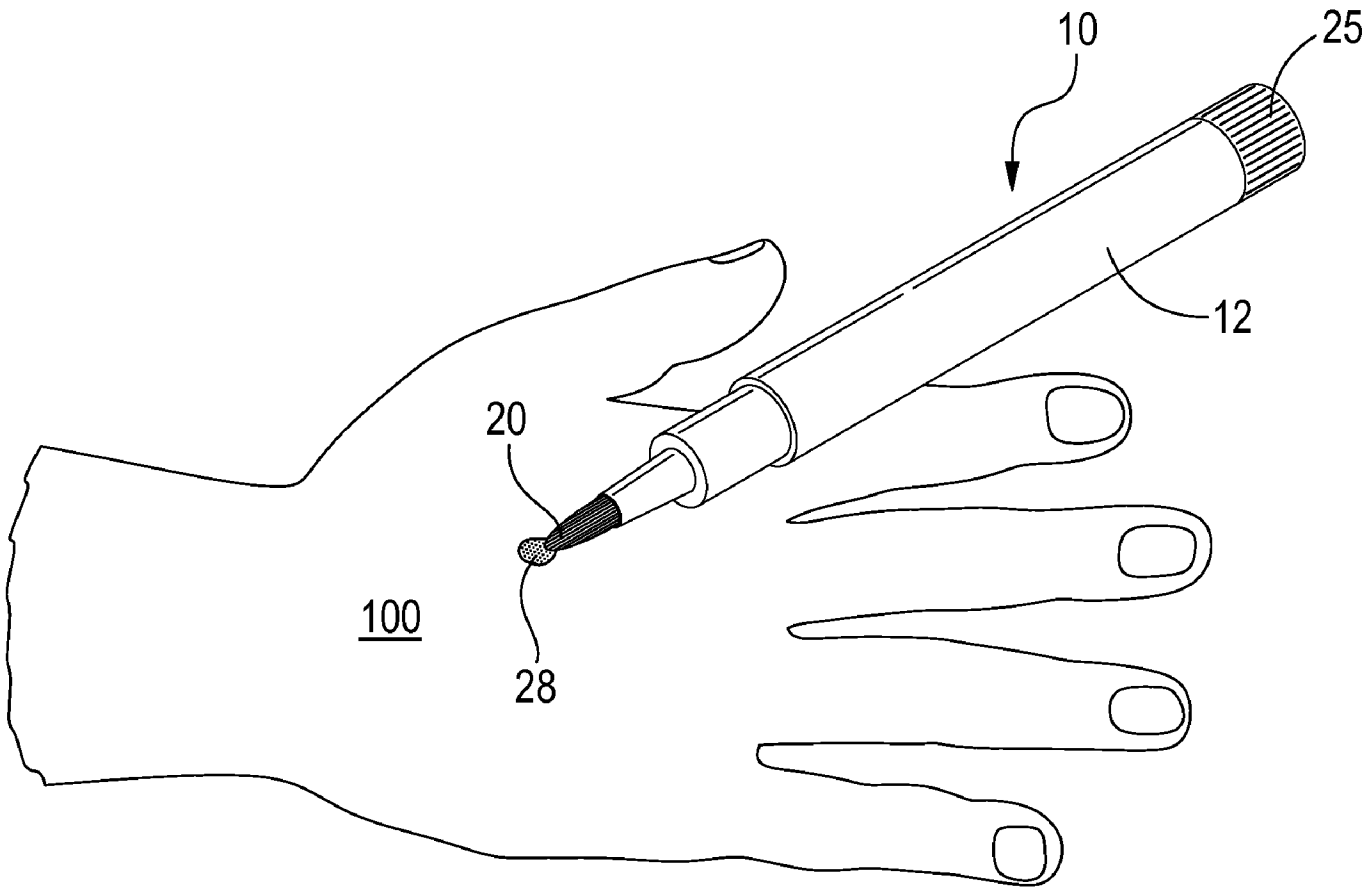
FIG. 3 shows the application of sunscreen to a mole using the applicator of FIG. 1.
Figure 4:
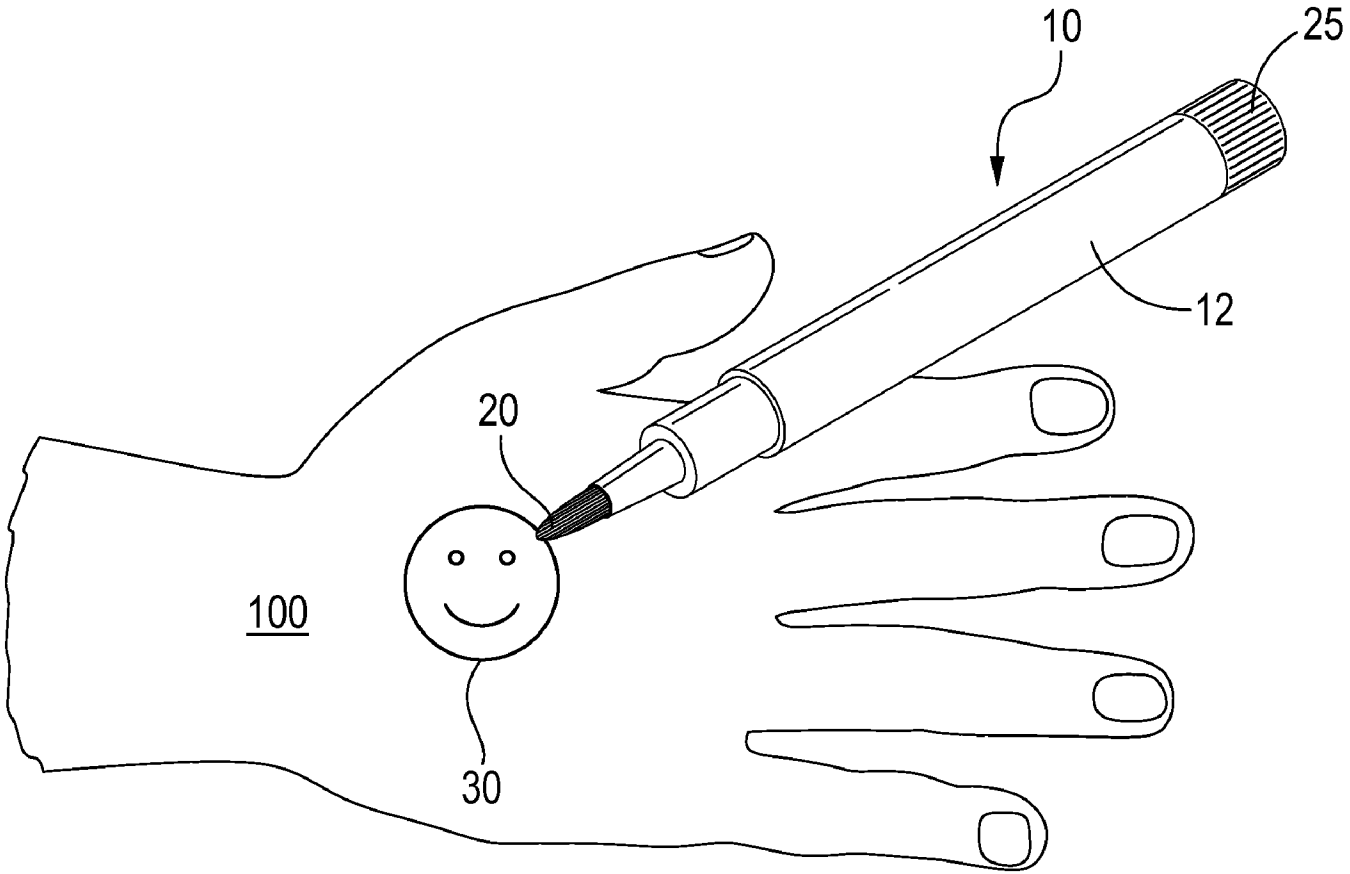
FIG. 4 shows the application of sunscreen to a tattoo using the applicator of FIG. 1.

FIGS. 1 and 2 depict a precision sunscreen applicator in accordance with a preferred embodiment of the present invention. FIGS. 3 and 4 depict methods of using the sunscreen applicator of FIGS. 1 and 2. Referring to FIGS. 1 and 2, sunscreen applicator 10 includes an elongated body 12 having a closed first end 14 and an open second end 16. A plurality of bristles that together form a brush 18 extend out from and are anchored to second end 16 of elongated body 12. Brush 18 has an exposed end 20 having a length of ½ inch for applying a sunscreen 21 directly to a user's skin and an enclosed end 22 for securing the brush to and within elongate body 12.

As depicted in FIG. 2, enclosed end 22 of brush 18 extends into second end 16 through a round opening 24. Opening 24 forms a neck 26 which compresses the bristles of brush 18 for holding the bristles therein and providing brush 18 with a substantially round cross-section. Opposite opening 24, neck 24 constricts to inhibit the flow of sunscreen 21 through neck 24 before opening into an elongated reservoir 26 that contains sunscreen 21. Reservoir 26 and sunscreen 12 remain in constant fluid communication with brush 18 so that the sunscreen can be transmitted along brush 18 and ultimately applied to a user's body via exposed end 20 of the brush.

To ensure that brush 18 contains a desired amount of sunscreen 21, a manually operated plunger 23 is located within reservoir 26. When actuated, plunger 23 is configured to advance from a position within reservoir 26 about closed first end 14 toward open second end 16. As plunger 23 advances toward closed end 14, sunscreen 21 is compressed within reservoir 26 and an amount of sunscreen 21 is forced through the constriction in neck 24, through neck 24 and onto brush 18. Plunger 23 my be pressed against sunscreen 21 in any known manner such as by simply pressing the plunger with a user's finger or a rod coupled to the plunger. Preferably, plunger 23 is advanced by turning a knob 25 about closed end 14 that is operatively coupled to a screw drive 27 that rotates within a threaded opening through plunger 23. Thus, as screw drive 27 is rotates, plunger 23 advances in the direction of brush 18.

So that sunscreen 21 can be precisely applied only to those portions of a user's body as desired, brush 18 includes a limited number of the bristles and has a constrained diameter.

For purposes of this invention, brush 18 has a diameter ranging between 1/16 of an inch and 3/16 of an inch. More preferably, brush 18 has a diameter of 1/8 of an inch. However, once sunscreen 21 wets brush 18, often the tip of brush 18 will narrow to a point having a diameter that is considerably less than 1/16 of an inch. The small diameter of brush 18 allows sunscreen 21 to be applied to a spot on the user's body having a complimentary diameter. Further, it allows sunscreen to be applied in a line where the line has the same or a substantially similar diameter as brush 18. This way, sunscreen 18 can be applied precisely.

Since sunscreen 21 can be precisely applied from sunscreen applicator 10, applicator 10 has several applications. For example, referring to FIG. 3, applicator 10 can be used to apply sunscreen 21 to a point or a spot on the user's body 100. Thus, sunscreen applicator 10 can be used to apply sunscreen 21 to a mole 28 on user's body 100 since it is desired to protect moles from sunlight exposure for decreasing cancer risk. This is done by lightly contacting the tip of exposed end 20 of brush 18 to mole 28 to apply sunscreen 21 to a point on the mole. Depending on the size of mole 28, the tip may need to be lightly pressed against different areas of the mole until mole 28 is completely covered by sunscreen 21. Since sunscreen applicator 10 can be used to precisely apply sunscreen 21 to a single area having a controlled diameter, sunscreen can be applied to mole 28 only without applying any to the skin immediately surrounding the mole. This way, the surrounding skin can be tanned as desired, and no halo effect around mole 28 is experienced.

Sunscreen applicator 10 can also be used to apply a line of sunscreen having a controlled width to the user's body. This is helpful when applying sunscreen 21 to a cut or incision for inhibiting scarring or protecting a tattoo. For example, referring to FIG. 4, there is shown use of sunscreen applicator 10 for applying sunscreen 21 to a tattoo 30. In this instance, exposed end 20 of brush 18 is lightly pressed against tattoo 30, and tattoo 30 is traced by brush 18 resulting in a layer of sunscreen 21 being applied thereto in a line. The diameter of the line of sunscreen 21 is complimentary with the diameter of brush 18. Accordingly, depending on the width of the various portions of tattoo 30, multiple passes of brush 18 along tattoo 30 may be required.

Figure 5:
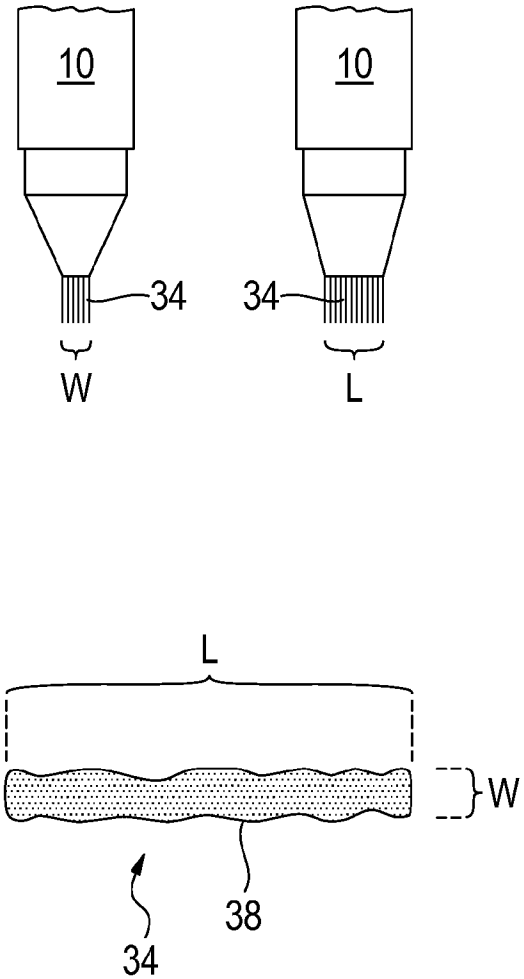
FIG. 5 is a perspective view of an alternative applicator tip for the sunscreen applicator of FIG. 1.
Figure 5:
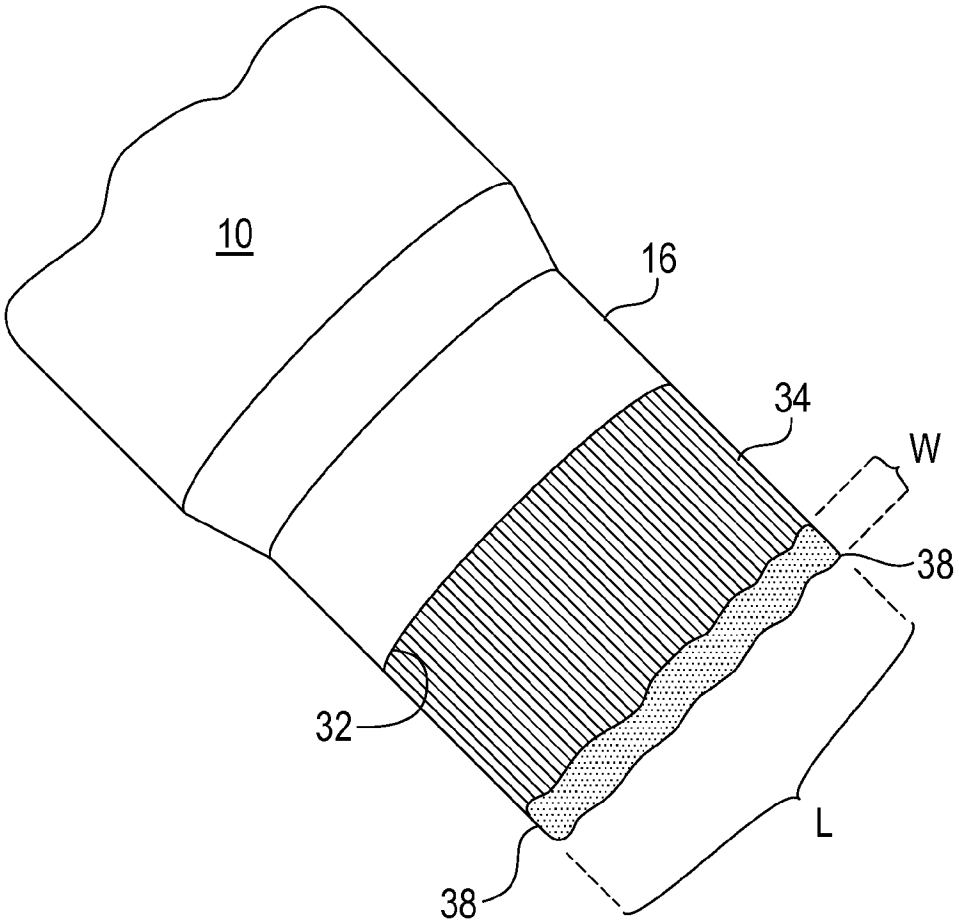

Since a tattoo may be composed a thin or thick lines or include large areas of solidly inked skin, alternative applicator brush configurations are contemplated. For example, referring to FIG. 5, there is shown sunscreen applicator 10 wherein open second end 16 includes a narrow, elongated opening 32 rather than a round opening as in applicator 10 of FIGS. 1 through 4. This provides for a brush 34 having a cross-section 38 with a length L that is several times greater than its width W. Thus, when in use, brush 34 can be touched to the user's body and moved perpendicularly to the length of brush 34 to apply a wide layer of sunscreen 21 or perpendicular to the width W of brush 34 to apply a narrow layer sunscreen 21 to the user's body. Brush 34 can also be used to apply sunscreen 21 to a point on the user's body by lightly touching a corner 36 of brush 34 to the user's body when a small spot on the user's body is to be covered with sunscreen 21.

Figure 6:
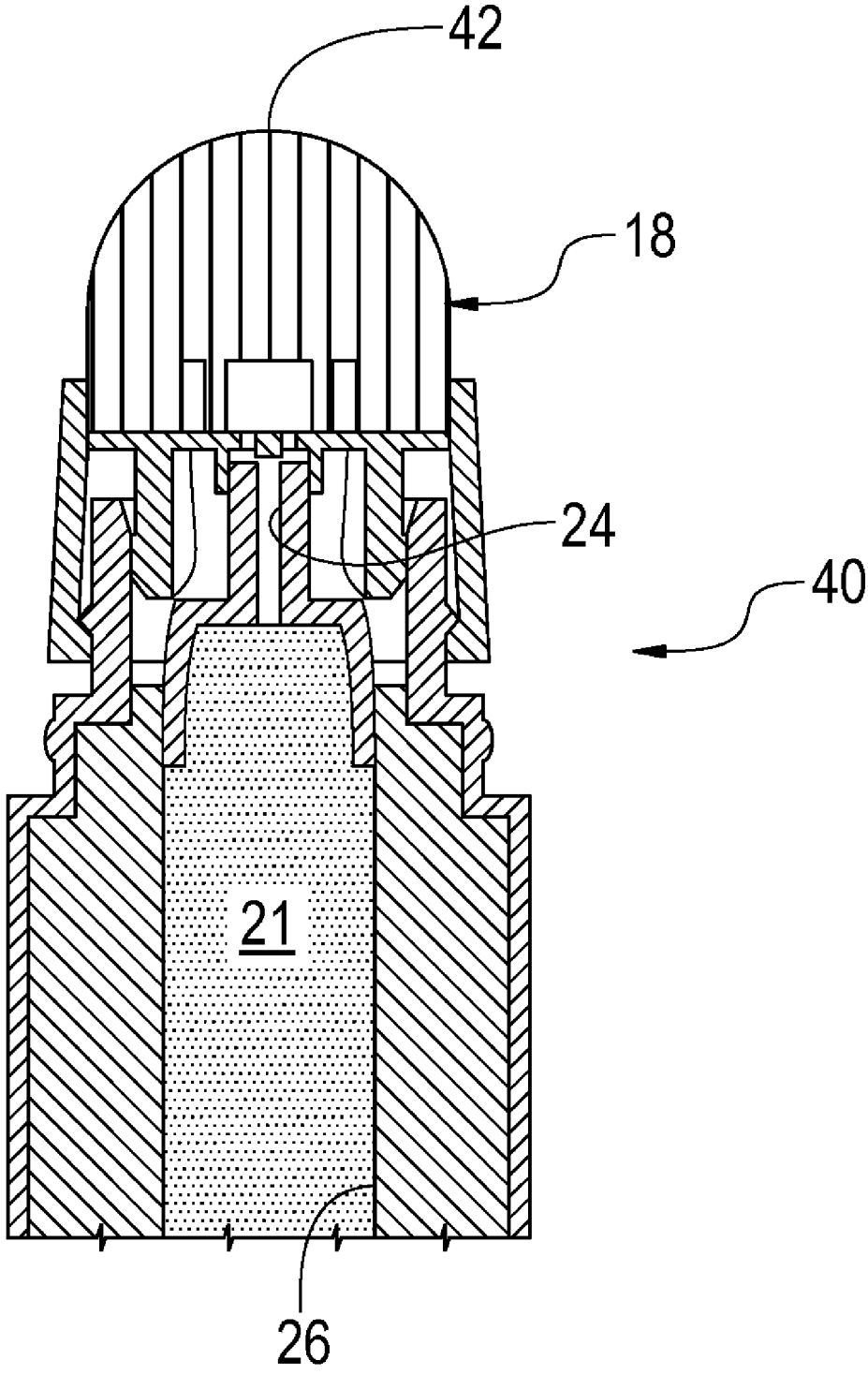
FIG. 6 is a perspective view of an alternative sunscreen applicator in accordance with a preferred embodiment of the invention.

Referring to FIG. 6, there is depicted an FIG. 1 a sunscreen applicator 40 in accordance with a preferred embodiment of the invention. Like applicator 10, applicator 40 includes sunscreen 21 within reservoir 26 which is in fluid communication with brush 18 through neck 24. Unlike applicator 10, the brush of applicator 40 has a rounded, exposed surface 42. This allows the applicator 10 to apply relatively narrow swathes of sunscreen 21 by lightly touching surface 42 to user's body 100. Alternatively, surface 21 can be pressed with more force against user's body 100 to apply wide swathes of sunscreen 21.

As will be apparent to one skilled in the art, various modifications can be made within the scope of the aforesaid description. Such modifications being within the ability of one skilled in the art form a part of the present invention and are embraced by the claims below.

It is claimed:

1. A method of applying sunscreen to a body comprising providing an applicator having a reservoir containing a sunscreen and an applicator tip in fluid communication with the reservoir, the tip having a diameter of less than 3/16 of an inch and being configured for applying the sunscreen to a predetermined line on a user's body, wherein the predetermined line is a tattoo, and applying the sunscreen from the tip to the tattoo without substantially applying the sunscreen to non-tattooed skin that is directly adjacent to the tattoo.

2. The method according to claim 1 wherein the sunscreen is not applied to non-tattooed skin.

3. The method according to claim 1 further comprising applying the sunscreen in a manner that obstructs access of sunlight to the predetermined line while simultaneously allowing unobstructed access of sunlight to the user's body in an area immediately adjacent the predetermined line.

4. The method according to claim 1 further comprising preventing the formation of a halo of lesser tanned skin about the predetermined line.

5. A method of applying sunscreen to tattooed skin comprising providing an applicator having a reservoir containing a sunscreen and an applicator tip in fluid communication with the reservoir, the tip having a diameter of less than 3/16 of an inch and being configured for applying the sunscreen to a predetermined point and along a predetermined line on a user's body, and applying the sunscreen from the tip to the tattooed skin without substantially applying the sunscreen to non-tattooed skin that is directly adjacent to the tattooed skin.

6. The method according to claim 5 wherein the predetermined line is less than 3/16 of an inch.

7. The method according to claim 5 wherein no sunscreen is applied to the non-tattooed skin.

8. The method according to claim 5 further comprising applying the sunscreen in a manner that obstructs access of sunlight to the predetermined line while simultaneously allowing unobstructed access of sunlight to the non-tattooed skin that is directly adjacent to the tattooed skin.

9. The method according to claim 5 further comprising preventing the formation of an area about the non-tattooed skin that is directly adjacent to the tattooed that is more darkly tanned than the non-tattooed skin that is directly adjacent to the tattooed skin.

* * * * *